US005092016A

United States Patent [19]

Soong

[11] Patent Number: 5,092,016

[45] Date of Patent: Mar. 3, 1992

[54] REMOVABLE GROMMET PAD AND METHOD OF USE

[76] Inventor: Tsai C. Soong, 1839 Jackson Rd., Penfield, N.Y. 14625

[21] Appl. No.: 604,449

[22] Filed: Oct. 29, 1990

[51] Int. Cl.[5] ..... F16L 5/00; A63B 49/00

[52] U.S. Cl. ..... 16/2; 273/73 D

[58] Field of Search ..... 16/2; 24/713.6, 713.7, 24/713.8; 273/73 D

[56] References Cited

U.S. PATENT DOCUMENTS

| | | | |
|---|---|---|---|
| 53,234 | 3/1866 | Richards | 24/713.7 |
| 813,575 | 2/1906 | Nichols | 16/2 |
| 2,209,274 | 7/1940 | Jaberg | 16/2 |
| 2,258,745 | 10/1941 | Dewey et al. | 16/2 |

*Primary Examiner*—Robert L. Spruill
*Assistant Examiner*—Carmine Cuda
*Attorney, Agent, or Firm*—Bernard A. Chiama

[57] ABSTRACT

A grommet pad for use with a sports racket having a frame formed with string holes for a string network and utilizing hollow grommets, having a flared end connecting to a long stem to support and guide strings through the frame, the grommet pad is adapted to at least one of the holes with the grommet, comprising, (a) a thin curved member formed at one end with a sharp tip adapted to be removably inserted into the clearance spacing between the the outer surface of the stem and the inner surface of the string hole, and (b) a curved support portion connected to the member at the end opposite the tip end and extending toward the interior of the frame, the portion being arranged for supporting the overhanging extended length of the grommet stem associated therewith against the force exerted thereon by the string passing there through toward the string network.

9 Claims, 3 Drawing Sheets

REMOVABLE GROMMET PAD AND METHOD OF USE

INVENTION BACKGROUND

In a sports racket comprising a string network, plastic grommet or grommet strip is often used to protect the string or the frame from cutting into each other when a tension force is put to the string. Grommet is made of relatively soft plastics, it is resilient, but it may be damaged by pressing hard against the sharp edge of the hole of a racket frame, which is made of aluminum or reinforced graphite fiber materials. It is especially vulnerable when the string is making a sharp turn after exiting from the grommet towards the interior of the string network, because the overhanging length of the grommet is then being bent sharply against the sharp inner edge of the hole by the pulling force from the string. If the string force is large, the contact with the sharp inner edge will either make the frame cutting into the grommet or the inner edge of the frame crushed by the compression from the grommet.

The present invention resolves the problem by having a removable grommet pad with suitable supporting backing material which can be inserted into the clearance spacing between the outer surface of the grommet and the inner surface of the hole in the frame wherein the pad is firmly held in place by the string force, providing the required support to protect the grommet and frame from cutting into each other.

INVENTION DESCRIPTION

The drawings are understood as currently preferred, however, the invention is not limited to the precise arrangement and geometries shown.

Figure 1:
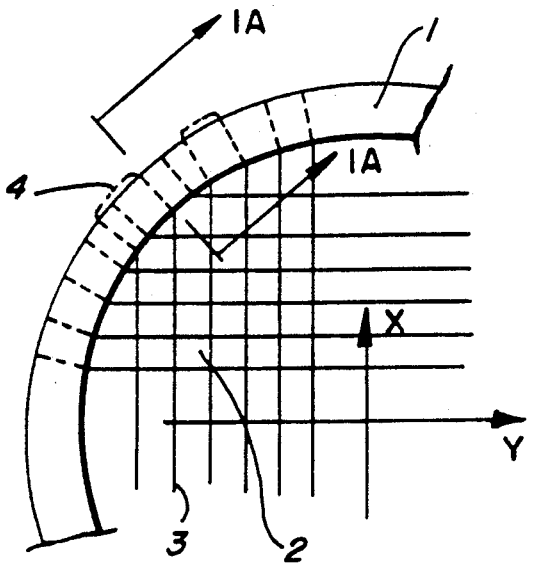
FIG. 1 PRIOR ART
FIG. 1 shows the top view of a portion of the frame head of a sports racket and FIG. 1A shows a cross sectional view in the X-Y plane.
Figure 1A:
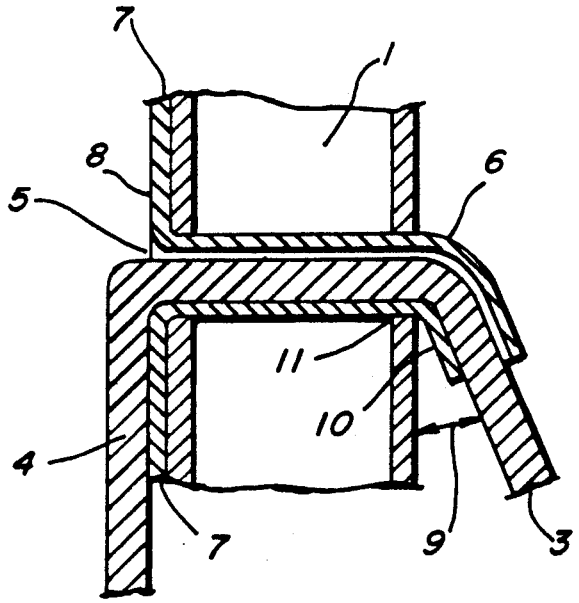
FIG. 1A PRIOR ART

FIG. 1 shows the top view of a portion of the head of the frame 1 of a conventional sports racket, where the X-Y plane is the mid-plane of the frame section coinciding with the plane of the string network 2. The frame 1 may be solid or hollow in its cross section. Holes are made in the frame in the plane of the string network for strings, such as 3,4, to pass through to the interior of the head frame to make a string network. The holes are made perpendicular to the outer contour of the frame. The grommet, one for each hole, may be connected together, if desired and applicable, by a common strip, especially at the head portion or along the two sides of the head frame. The grommets and the connecting strip is often called a grommet strip or bumper guard. The grommet has a constant diameter stem, one end ready to be inserted into the hole from the outboard side, and the other end connecting to a flaring shoulder to support and guide the incoming string. The clearance spacing between the grommet stem and the hole is very small. The cross section FIG. 1A is cut in the X-Y plane containing the longitudinal string 3 and its extended length 4 wrapping around the outer periphery of the frame. In the FIG. 1A section, it is shown the hollow frame 1 has a hole 5 which admits a conventional grommet 6 extending from a connecting strip 7. The stem enters from 5 and exits towards the right side to the string network 2 in which the string 3 belongs. The grommet has a flared end 8 at the outboard side of the frame, its long stem has a constant diameter which is a little smaller than the diameter of the hole in the frame. The length of the stem is such that it is longer than the length of the hole in the frame. For tennis racket, the overhanging length of a grommet outside of the hole is about 1.0 to 4.0 mm. The string 3 is exerting a string force along the direction of 3. The angle 9 is determined by the stringing pattern and when the angle is sharp as is shown in the figure, the grommet is bent sharply at 10 and severe compression develops between the grommet and the frame at that local contact arc. The great compression will cause local damage, such as crack 11, to the frame or to the grommet. This is a very common cause of racket damage and usually calls for a restringing job.

Figure 2A:
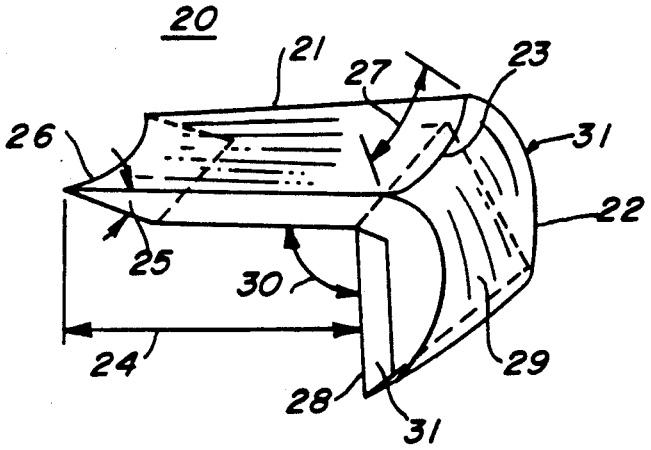
FIG. 2A, 2B show preferred embodiments of the invention.

FIG. 2A shows the geometry of a preferred embodiment of the invention, a removable grommet pad 20. The material of the pad may be plastic, reinforced plastic, metal, or other suitable material. It may be made by machining, injection molding, or other suitable methods. It has two parts: an insertion part in the form of a curved member, 21, and a convexly curved support part 22. The curved member has a radius 23 which is about the same as that of the stem of the grommet. The length 24 is to be completely inserted into the clearance space between the grommet and the hole, inserted from the exit end of the hole of the frame towards the outboard side. The tip angle 25 of the tip 26 should be sharp, to make the insertion easy. The arc length of the sleeve 27 should be sufficient to wrap around enough boundary of the grommet so that the frictional force will be sufficient to pin down the curved member against any undesirable movement. The support part 22 has a plain edge 28, and a curved, convex side 29 providing a cushion bend for the overhanging length of the grommet to rest on under the pull of the string. The angle 30, between 21 and 28, may be varied from about 90 degrees to a larger angle to suit different stringing pattern. Less than 90 degrees is rare. The recess 31 made on both lateral sides of 22, is created for the purpose that fingers can pry into the recess to pull the pad away from the hole if the pad is to be removed. These subtle, user friendly, geometrical features are important for a practical removable pad to be easily adapted to the frame.

For tennis racket application, the wall thickness of the curved member 21 is preferred to be between about 0.10 to 0.70 mm (0.004 to 0.028 inch) which is about the range of the clearance spacing between the grommet and the corresponding hole. A preferred thickness for the plastic pad for the tennis racket frame is about 0.25 to 0.50 mm. For metal pad, it is about from 0.10 to 0.25 mm. The tip 26 should be sharp, a taper of about 30 degrees is recommended as the upper limit, a taper less than about 15 degrees is preferred. The length of the member 24 is about 1.5 to 8.0 mm (0.06 to 0.31 inch), enough to cover at least the wall thickness of a hollow frame, but not too long to hit the inside of the wall at the outboard side. This range is also approximately reasonable for application to solid section tennis racket frames, such as I-beam type frames. A preferred range of 24 is between 2.5 to 6.4 mm (0.10 to 0.25 inch). The angle 27 subtended by the circular arc of 21 of FIG. 2A is preferred between about a quarter to about one-half of the total circumference. The diameter of the grommet follows the convention. The overall width of the support 22 along the direction perpendicular to the axis of the stem is preferred to be larger than the width of 21 for a firm support between the wall of the frame and the attached pad.

Figure 2B:
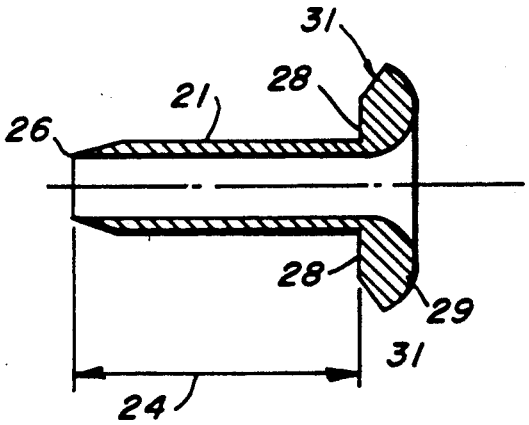

FIG. 2B shows the cross section of yet another viable embodiment wherein the pad is an axisymmetric complete ring instead of a segment as shown in FIG. 2A. FIG. 2B configuration resembles a conventional grommet with its flared end placed inward. However, the noval idea of having an edge very sharp, the wall of the stem very thin, having the curved shoulder outside the hole to support the grommet and holding the pad in place by the string force, seemed not obvious to people in the trade in the past even though they been exposed to the conventional grommet for that long.

The FIG. 2A embodiment can be used even when the clearance is very small, because it can shove the grommet stem towards the wall and squeeze the whole length of 24 into the clearance spacing once its tip edge 26 gets into the opening. Obviously the FIG. 2B embodiment needs a greater clearance between the grommet and the hole, because it has to completely surrounding the grommet. A particular embodiment derived from FIG. 2B is that the sleeve may surround the stem completely but the support portion 22 only surrounds the circumference of the grommet partially as in FIG. 2A.

Figure 3:
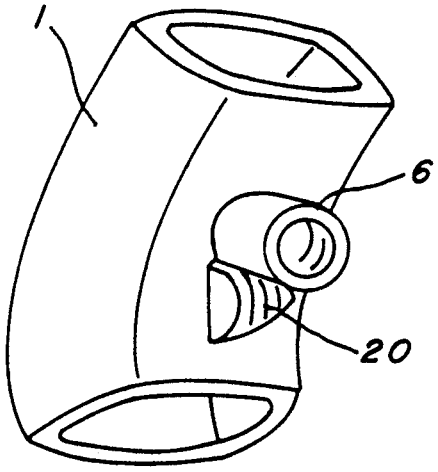
FIG. 3 shows a grommet pad installed at a hole.
Figure 4:
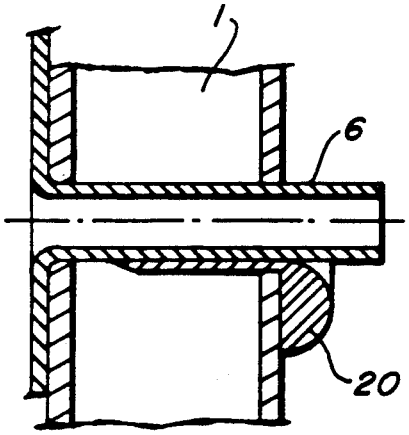
FIG. 4 shows the cross section of the frame with the grommet and the pad in place.
Figure 5:
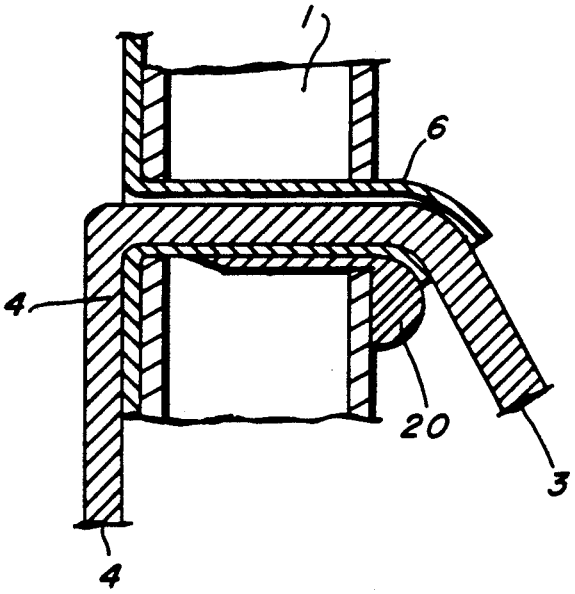
FIG. 5 shows the string passing through the FIG. 4 grommet and pad and the string bending the grommet around the pad.

FIGS. 3 to 5 show how the pad is to be adapted to a hole in the frame. FIG. 3 is a sketch of having a FIG. 2A removable grommet pad 20 installed under a grommet 6. FIG. 4 is a cross section of the FIG. 3 installation. FIG. 5 is a cross section of FIG. 3 installation with the string 3 in place. With the pad 20 in place to support the overhanging length of the grommet, damage between the grommet and the edge of the hole of the frame can be avoided. Comparing FIG. 5 and FIG. 1, the reduction in the compression of the grommet near the exit point 10 is evident. Comparing embodiments of FIGS. 2A and 2B, there is a big advantage of FIG. 2A pad over the FIG. 2B pad. Due to the sharp downward drooping of the overhanging stem after exitting from the hole, caused by the string force, the inner surface 28 of the complete ring of FIG. 2B pad will tilt at a noticeable angle towards the direction in which the string is pulling. This warping does not look good in appearance. High priced racket may reject the use of such warped pad. The FIG. 2A pad has no such cosmetic defect.

The geometric description made so far reflects a plastic pad which has varied thickness in the curved member and in the curved support portion, indicating a hardware most suited for injection molding. However, a sheet of metal, say stainless steel of a thin gauge, say about 0.15 mm, may very well be just as suitable in function. In that case, the insertion into the clearance spacing would present no problem and the forming of the circular member 21 and the forming of the saddle-shaped, double curvatured part 22 would also be within the technology of metal forming.

Since the grommet pad does not extend to the outboard end of the grommet stem, it is obvious that the invention can be applied to frames in which grommets are placed in the holes independently without having a common strip connecting them. Also, even though the hole, the stem, and the grommet pad are described as circular and the words radius and diameter are often associated with the geometry, the application does not have to be made only for circular stems in circular holes. The curve 21 may be of a curvature different from circular.

Various other modifications that would occur to skilled workmen in the field may be assumed to come within the scope of the following claims.

What is claimed is:

1. A method for protecting a grommet stem and the frame for a sports racket formed with holes for a string network supported by the frame wherein one or more of the stems project into at least some of the holes and produce tight clearance spacings therebetween and may become damaged thereby, and wherein the one or more grommet stems being formed with an overhanging extending end protruding beyond the associated hole inwardly toward the string network, comprising inserting into the clearance spacing between the outer surface of a stem and the inner surface of a hole receiving the stem a curved member having a sharp end tip formed at its insertion end, a curved support portion connected at its other end and a curved arc length of approximately a quarter to one half of the total circumference thereof, and positioning said curved member whereby said overhanging extended end of the one or more grommet stems is applied around said curved support portion of said curved member produced by the force of a string thereagainst.

2. A grommet pad for use with a sports racket having a frame formed with string holes for a string network and utilizing hollow grommet stems projecting into at least some of the holes wherein the clearance spacing between a hole and a stem is necessarily tight for string placement, each of the grommet stems being formed with an overhanging extending end for supporting strings through the frame, comprising a) a curved member formed at one end with a sharp tip adapted to be removably inserted into the tight clearance spacing between the outer surface of the stem and the inner surface of at least one of said some of the string holes, said curved member having a curved arc length of approximately a quarter to one half of the total circumference thereof, b) a curved support portion connected to said member at the end opposite said tip end and extending toward the interior of the frame, said portion being arranged for supporting said overhanging extended length of the grommet stem associated therewith against the force exerted thereon by the string passing therethrough toward the string network.

3. The grommet pad according to claim 2 wherein the width of said support portion in the direction perpendicular to the axis of the stem is wider than the width of said curved member.

4. The grommet pad according to claim 2 wherein the length of said curved member when positioned within its associated string hole is between about 1.5 to 8.0 mm, and the width of said support portion is at least equal to the width of said curved member.

5. The grommet pad according to claim 4 wherein the thickness of said curved member is approximately between 0.10 and 0.70 mm.

6. The grommet pad according to claim 2 wherein said curved member surrounds the grommet stem inside the hole in all its circumferences.

7. The grommet pad according to claim 6 wherein said support portion is also axisymmetric.

8. The grommet pad according to claim 2 wherein the longitudinal axis of said curved member and the inner surface of said support portion defines an angle greater than 90 degrees.

9. The grommet pad according to claim 2 wherein said curved member and said support portion are made of sheet steel.

* * * * *